US005919559A

United States Patent [19]

Nakano et al.

[11] Patent Number: 5,919,559

[45] Date of Patent: Jul. 6, 1999

[54] RECORDING SHEET

[75] Inventors: Yukihiro Nakano, Wakayama; Masafumi Miyamoto, Tochigi; Yasuhiro Doi, Wakayama, all of Japan

[73] Assignee: Kao Corporation, Tokyo, Japan

[21] Appl. No.: 08/716,742

[22] Filed: Sep. 23, 1996

[30] Foreign Application Priority Data

| | | | |
|---|---|---|---|
| Oct. 12, 1995 | [JP] | Japan | 7-263924 |
| Dec. 22, 1995 | [JP] | Japan | 7-334755 |
| Dec. 22, 1995 | [JP] | Japan | 7-334756 |
| Aug. 8, 1996 | [JP] | Japan | 8-209626 |

[51] Int. Cl.[6] ..... B41M 5/00

[52] U.S. Cl. ..... 428/331; 428/195; 428/520

[58] Field of Search ..... 428/195, 520, 428/480, 913, 331

[56] References Cited

U.S. PATENT DOCUMENTS

| | | | |
|---|---|---|---|
| 4,954,395 | 9/1990 | Hasegawa et al. | 428/195 |
| 5,006,407 | 4/1991 | Malhotra | 428/195 |

FOREIGN PATENT DOCUMENTS

| | | |
|---|---|---|
| 60-56587 | 4/1985 | Japan . |
| 60-198285 | 10/1985 | Japan . |
| 61-132376 | 6/1986 | Japan . |
| 1-146784 | 6/1989 | Japan . |
| 1-146785 | 6/1989 | Japan . |
| 4-214382 | 8/1992 | Japan . |
| 4-265784 | 9/1992 | Japan . |

*Primary Examiner*—Pamela H. Schwartz

*Attorney, Agent, or Firm*—Birch, Stewart, Kolasch & Birch, LLP

[57] ABSTRACT

The present invention provides an ink jet recording sheet having a good printing quality and an excellent ink absorbency. The recording sheet comprises a substrate sheet and an ink-absorbing layer, provided on at least one face of the substrate sheet, containing a water soluble resin or water dispersible resin (A) and an ester group-possessing nonionic surfactant (B) having an HLB of 11 or more, wherein the ratio of the component (A) to the component (B) is (A):(B)=100:0.01 to 30 (weight ratio).

10 Claims, No Drawings

RECORDING SHEET

FIELD OF THE INVENTION

The present invention relates to a recording sheet for which a water-base ink is used, more specifically to an ink jet recording sheet having a good printing quality and an excellent ink absorbency.

ARTS IN THE BACKGROUND

Since ink jet recording is noiseless and makes high-speed recording possible, it has been employed in terminal printers and has recently been rapidly spreading. Use of many ink nozzles makes it possible to carry out multicolor recording, and multicolor ink jet recordings based on various ink jet recording systems are available.

Water base inks comprising water as a principal component are used as this ink jet recording ink in terms of safety and recording characteristics, and in order to prevent clogging of nozzles and raise discharge characteristics, polyhydric alcohols are added in many cases.

Accordingly, recording sheets used for the above ink jet recording system have to satisfy various physical properties such as:

① quickly absorbing a water base ink and not being blurred with the ink,

② excellent storage stability (images are not blurred by storage over a long period of time), ③ high adhesion of a substrate to an ink-absorbing layer, ④ no stickiness for convenience of handling, ⑤ possible of continuously printing (no adhesion between sheets), and ⑥ having high transparency in the case where the sheet is used for OHP (overhead projector).

Satisfaction of these requirements depend largely on the characteristics of sheets used, and the existing situation is that recording sheets satisfying all of these required physical properties have not yet been found.

In order to improve, for example, a printing property, a drying property after printing, and stickiness, several recording sheets in which surfactants are compounded in ink-absorbing layers have been proposed (JP-A-60-56587, JP-A-60-198285, JP-A-61-132376, JP-A-1-146784, JP-A-1-146785, JP-A-4-214382, and JP-A-4-265784).

However, the recording sheets described in these publications are not sufficiently satisfactory in terms of a printing quality, which may be attributable to improper combination of water soluble polymers used and surfactants.

DISCLOSURE OF THE INVENTION

Accordingly, an object of the present invention is to provide a recording sheet having a good printing quality and an excellent ink absorbency.

The preceding object of the present invention has been achieved by a recording sheet comprising a substrate sheet and an ink-absorbing layer, provided on at least one face of the substrate sheet, containing a water soluble resin or water dispersible resin and a specific surfactant.

That is, the present invention relates to a recording sheet comprising a substrate sheet and an ink-absorbing layer, provided on at least one face of the substrate sheet, containing a water soluble resin or water dispersible resin (A) and an ester group-possessing nonionic surfactant (B) having HLB of 11 or more, wherein the ratio of the component (A) to the component (B) is (A):(B)=100:0.01 to 30 (weight ratio). As above below, the sheet of the invention comprises the substrate and the ink-absorbing layer. The ink-absorbing layer comprises (A) a water-soluble or water-dispersible resin and (B) a nonionic surfactant; (A), (B) and (C) a polyhydric alcohol; (A), (B) and (D) particles of a cross-linked silicone; (A), (B), (C) and (D); (A), (B) and (E) a modified, layered silicate or a modified, phyllosilicate; (A), (B), (D) and (E); (A), (B), (C) and (E); or (A), (B), (C), (D) and (E).

The present invention shall be explained below in detail.

Any one of transparent or opaque conventional substrates can be used as the substrate which is used as a support for the ink-absorbing layer in the present invention. Substrates suitable as the transparent substrate include polyester, polyolefin, polyamide, polyesteramide, polyether, polyimide, polyamidimide, polystyrene, polycarbonate, poly-p-phenylenesulfide, polyetherester, polyvinyl chloride, poly(math)acrylate, cellophane, and celluloid. Substrates obtained by subjecting the transparent substrates described above to opacification treatment by publicly known methods are used as the opaque substrates. Also, copolymers and blends thereof can be used as well. Further, in order to raise an adhesion of the substrate to the ink-absorbing layer, the substrate can be subjected to anchor coating treatment and corona discharge treatment or can be blended with a hydrophilic agent, such as nonionic, anionic and cationic surfactants known to public. Thicknesses of these substrates shall not be specifically restricted, and the sheets having thicknesses of 10 to 500 $\mu$m, preferably 30 to 300 $\mu$m are used in terms of easiness in insertion when the sheets are put into printing machines.

Among the substrates described above, polyester, particularly polyethylene terephthalate is preferably used in terms of thermal and mechanical characteristics and workability.

In the case where the recording sheet of the present invention is used for OHP requiring transparency, it has preferably a transmittance of 75% or more to light having a wavelength of 700 nm.

In the present invention, the ink-absorbing layer contains the water soluble resin or a water dispersible resin (A) and the ester-group possessing nonionic surfactant (B) having HLB of 11 or more and preferably further contains at least one selected from polyhydric alcohol (C), cross-linked silicone particles (D) having particle diameters of 0.5 to 50 $\mu$m, and layered silicate (E) modified with an organic treating agent.

Since a water-base ink is used for an ink jet printer, the water soluble resin or water dispersible resin (A) in the present invention is a base material necessary for absorbing the ink. The water soluble resin or water dispersible resin (A) includes, for example, sweat potato starch, potato starch, oxidized starch, phosphoric acid starch, carboxylated starch, hydroxyethylated starch, cyanoethylated starch, acrylic acid-grafted starch, methyl cellulose, hydroxyethyl cellulose, carboxyethyl cellulose, hydroxypropyl cellulose, hydroxypropylethyl cellulose, cellulose sulfate, dextrin, corn starch, konjak, funorin, agar, sodium algate, Nibicus manihot, tragacanth gum, gum arabic, roacast bean gum, gua gum, pectin, karaginin, glue, gelatin, casein, soybean protein, albumin, completely or partially saponified polyvinyl alcohol and anionic and cationic modifications of said polyvinyl alcohol, polyvinyl alcohol having a acetalization degree or butylalization degree of 30% or less, polyacrylamide and copolymers thereof, polyvinylpyrrolidone and copolymers thereof, polyethylene oxide, polypropylene oxide, ethylene oxide-propylene oxide copolymers, polybutylene oxide, carboxylated polyethylene oxide, polyacrylic acid and sodium salt thereof, a styrene-maleic acid copolymer, and an ethylene-maleic acid copolymer. A mixture of each at least one of these water soluble resins or water dispersible resins can be used as well.

Among these resins, in particular, partially saponified polyvinyl alcohol having a saponification degree of 65 to 90% and an average polymerization degree of 400 to 5000 or cation-modified polyvinyl alcohol having cationic group-possessing polymerization unit in 0.01 to 25 mole % based on total polymerization units and an average polymerization degree of 400 to 5000 is used in terms of a film-forming property, an ink-absorbing property, and transparency. In particular, partially saponified polyvinyl alcohol having a saponification degree of 75 to 80% and an average polymerization degree of 1000 to 3000 or cation-modified polyvinyl alcohol having cationic group-possessing polymerization unit in 0.1 to 10 mole % based on total polymerization units and an average polymerization degree of 1000 to 3000 is used in terms of a printing property and processability. A saponification degree of the cation-modified polyvinyl alcohol shall not specifically be restricted and is preferably 65 to 90 mole %.

The partially saponified polyvinyl alcohol used in the present invention can be synthesized by conventional methods and prepared by controlling polyvinyl acetate to a desired saponification degree by acid saponification or alkali saponification.

In the present invention, the cation-modified polyvinyl alcohol means polyvinyl alcohol having cationic groups such as primary to tertiary amino groups and quaternary ammonium salt groups on a principal chain or side chains. The cation-modified polyvinyl alcohol used in the present invention is obtainable by copolymerizing polyvinyl acetate with vinyl compound monomers having groups which can readily be turned into cationic groups, including at least one of vinyl monomers having quaternary ammonium salt groups (or precursor groups thereof, that is, primary to tertiary amino groups), such as hydroxyethyltrimethylammonium chloride, 2,3-dimethyl-1-vinylimidazolinium chloride, trimethyl-(3-acrylamido- 3,3-dimethylpropyl) ammonium chloride, trimethyl-(3-methacrylamidopropyl) ammonium chloride, N-(1,1-dimethyl-3-dimethylaminopropyl)acrylamide, and N-(3-dimethylaminopropyl)methacrylamide, or o-, m-, or p-aminostyrene or monoalkyl or dialkyl derivatives thereof, or quaternary ammonium salts thereof; or o-, m-, or p-vinylbenzylamine or monoalkyl or dialkyl derivatives thereof, or quaternary ammonium salts thereof; N-(vinylbenzyl)pyrrolidine; N- (vinylbenzyl)-piperidine; N-vinylpyrrolidone; α-, β-vinylpiperidine or quaternary ammonium salts thereof; α-, β-piperidine or quaternary ammonium salts thereof; and other nitrogen-containing heterocyclic vinyl compounds such as 2-, 4-vinylquinoline or quaternary ammonium salts thereof, or nitro derivatives thereof, and saponifying the resulting copolymers by ordinary methods. Vinyl acetate is copoymerized first with other monomers having reactive groups, and after saponification, a cationic group-containing compound is reacted with the resulting copolymer by making use of such reactive groups, whereby polyvinyl alcohol can be saponified. Further, polyvinyl alcohol may directly be cationized by using compounds having groups capable of reacting with the hydroxyl groups contained in polyvinyl alcohol, and primary to tertiary amino groups or quaternary ammonium groups at the same time, for example, glycidyltrimethyl-ammonium chloride, by making use of the hydroxyl groups contained in polyvinyl alcohol.

These partially saponified polyvinyl alcohols may be used in a mixture of those having different polymerization degrees and saponification degrees. Also, the cation-modified polyvinyl alcohols may be used in a mixture of those having different polymerization degrees and saponification degrees. Further, these partially saponified polyvinyl alcohols and cation-modified polyvinyl alcohols may be used in a mixture of an optional ratio.

The surfactant (B) used in the present invention has to have HLB (Griffin method: W. C. Griffin, Kirk-othmer Encyclopedia of Chemical Technology, 3rd ed., Vol. 8, Weily Interscience, New York 1979, p. 900 to 930) of 11 or more in terms of compatibility with the water soluble resin or water dispersible resin. Since HLB of less than 11 decreases compatibility (dispersibility) with the water soluble resin or water dispersible resin, it tends to cause irregularities on the surface of the sheet (ink-absorbing layer), damage the appearance of the sheet and deteriorate the printed images. Further, the highly transparent sheet can not be obtained due to a difference in a refraction factor between the resin and the surfactant which is incompatible therewith. HLB is preferably 13.5 or more, more preferably 15.0 or more.

The surfactant (B) used in the present invention is an ester group-possessing nonionic surfactant. Said ester group-possessing nonionic surfactant enhances wettability to an ink and makes it easy to absorb the ink in the ink-absorbing layer. In particular, when polyvinyl alcohol is used as the water soluble resin or water dispersible resin, the above surfactant acts as a plasticizer for polyvinyl alcohol and reduces a crystallinity of polyvinyl alcohol to thereby increase the ink absorbing power. In contrary to this, while surfactants other than the ester group-possessing nonionic surfactant improve wettability to an ink, they do not have an effect to make it easy to absorb the ink in the ink-absorbing layer. This causes the ink to readily spread in the end of the sheet in a longitudinal direction and results in causing the inks which are not absorbed into the sheet to contact each other to bring about blur (blur is accelerated more than that of the sheet containing no surfactant in many cases).

The ester group-possessing nonionic surfactant (B) having an HLB of 11 or more includes polyoxyethylenesorbitan monopalmitate, polyoxyethylenesorbitan monostearate, polyoxyethylenesorbitan monolaurate, polyoxyethylenesorbitan monooleate, polyoxyethylenesorbitan trioleate, polyoxyethylenesorbit tetraoleate, polyoxyethylene monopalmitate, polyoxyethylene monostearate, polyoxyethylene monolaurate, polyoxyethylene monooleate, decaglycerol monostearate, hexaglycerol monostearate, decaglycerol monooleate, hexaglycerol monooleate, decaglycerol monolaurate, hexaglycerol monolaurate, decaglycerol monocaprylate, and hexaglycerol monocaprylate. These surfactants can be used alone or in a mixture of two or more kinds thereof.

Among these surfactants, particularly decaglycerin monolaurate, decaglycerin monocaprylate, polyoxyethylenesorbitan monolaurate in which an addition mole number of ethylene oxide is 17 moles or more, polyoxyethylenesorbitan monopalmitate in which an addition mole number of ethylene oxide is 18 moles or more, and polyoxyethylenesorbitan monolaurate in which an addition mole number of ethylene oxide is 12 moles or more are preferred since they markedly improve a printing property.

The blend amount of the ester group-possessing nonionic surfactant (B) having an HLB of 11 or more in the ink-absorbing layer is 0.01 to 30 parts by weight, preferably 0.01 to 20 parts by weight, more preferably 0.1 to 10 parts by weight, and particularly preferably 0.5 to 10 parts by weight per 100 parts by weight of the water soluble resin or water dispersible resin (A). The surfactant (B) of less than 0.01 parts by weight is not preferred since the effects of the surfactant are not attained. Meanwhile, the surfactant of more than 30 parts by weight is not preferred as well since a printing property and a handling property (particularly stickiness resistance) are deteriorated.

The polyhydric alcohol (C) is formulated in order to prevent curling of the recording sheet in storage and projection use by a humectant effect (prevent curling of the sheet due to moisture absorption and dehumidification in the ink-absorbing layer), improve an adhesion of the substrate to the ink-absorbing layer, and increase an ink-absorbing rate. The adhesion is considered to be improved because the polyhydric alcohol acts as a plasticizer for the water soluble resin or water dispersible resin [because of a reduction in Tg (glass transition point)], and therefore a tackiness (adhesion) of the water soluble resin or water dispersible resin is increased. Further, the ink-absorbing rate is considered to be enhanced as well because the polyhydric alcohol acts as a plasticizer for the water soluble resin or water dispersible resin and therefore makes it easy for an ink to be absorbed (but formulation of the polyhydric alcohol alone considerably reduces an effect to increase a printing property, and therefore the surfactant is necessary).

The polyhydric alcohol (C) includes ethylene glycol, trimethylene glycol, tetramethylene glycol, pentamethylene glycol, hexamethylene glycol, propylene glycol, glycerol, 2,3-butanediol, 1,3-butanediol, diethylene glycol, triethylene glycol, diethanolamine, triethanolamine, trimethylolpropane, pentaerythritol, sorbitol, and polyglycerol having a polymerization degree of 2 or more. Among them, particularly at least one selected from the group consisting of ethylene glycol, glycerol, trimethylene glycol, tetramethylene glycol, propylene glycol, diethylene glycol, and polyglycerol having a polymerization degree of 2 or more is used because of large effects given to an adhesion to the substrate and a printing property.

An amount of the polyhydric alcohol (C) formulated into the ink-absorbing layer is 0.01 to 30 parts by weight, preferably 0.1 to 20 parts by weight, and more preferably 0.5 to 10 parts by weight per 100 parts by weight of the water soluble resin or water dispersible resin (A). The polyhydric alcohol (C) of less than 0.01 parts by weight is not preferred since the effect of the polyhydric alcohol is not revealed. Meanwhile, the polyhydric alcohol of more than 30 parts by weight is not preferred as well since a printing property and a handling property (particularly stickiness resistance) are deteriorated.

The cross-linked silicone particles (D) having particle diameters of 0.5 to 50 $\mu$m are formulated for the purpose to provide a release agent effect (preventing stickiness and adhesion between the sheets). The release agent effect is attained by formulating the silicone particles in a small amount into an ink-absorbing layer, and no adverse effects are exerted on a printing property and transparency. Further, the particles have a good dispersion stability in the coating liquid and do not precipitate even after storage over a long period of time. In contrast to this, silica particles are used in many cases as a release agent for OHP sheets which are commercially available at present. However, when inorganic particles such as silica particles are used, they provide the problems that:

a. a dispersibility of silica is inferior, and the resulting sheet has a low transparency, b. in order to provide a sufficiently high stickiness resistance, a considerable amount thereof has to be compounded, and this exerts an adverse effect on a printing property and transparency, and c. the particles have an inferior dispersion stability in the coating liquid and settle down after storage over a long period of time (the particles which are stirred and dispersed immediately before coating hold bubbles and exert adverse effects on coating).

The compositions of the cross-linked silicone particles (D) include methyl silicone resins obtained by combining structural units of $SiO_2$, $CH_3SiO_{3/2}$, $(CH_3)$ SiO, and $(CH_3)_3$ $SiO_{1/2}$, methylphenyl silicone resins obtained by combining structural units of $CH_3Si_{3/2}$, $(CH_3)_2SiO$, $C_6H_5SiO_{3/2}$, $(C_6H_5)$ $(CH_3)$ SiO, and $(C_6H_5)_2SiO$, and alkid-modified, polyester-modified, acryl-modified, epoxy-modified, phenol-modified, urethane-modified and melamine-modified silicone resins thereof. The silicone content of these modified silicone resins is not specifically restricted as long as the characteristics of silicone are revealed. The silicone content is 5% by weight or more, preferably 15% by weight or more, and more preferably 50% by weight or more. The silicone content described above is calculated in accordance with the following formula:

{1-[(the weight of the modifier used for preparing the modified silicone particles)/(the weight of the modified silicone particles)]}×100 (%).

Further, dimethyl-type, methylvinyl-type, methylphenylvinyl-type, and methylfluoroalkyl-type silicone cross-linked rubbers can be given as the good materials. Fillers such as silica particles may be contained in these rubbers.

In particular, polymethyl silsesquioxane (Chemical Abstracts No. 68554-70-1) is preferably used in terms of a transparency of the sheet and a dispersion stability in the coating liquid.

A form of the cross-linked silicone particles (D) shall not specifically be restricted and may be various forms such as sphere and crushed matters. A particle diameter of the cross-linked silicone particles (D), though depending on a thickness of the ink-absorbing layer (the particles having larger particle diameters than the thickness of the ink-absorbing layer are preferably used in order to provide a stickiness resistance), falls preferably in a range of 0.5 to 50 $\mu$m in terms of the effects exerted on a handling property and a coating property. The particle diameter exceeding 50 $\mu$m does not provide an appropriate dot form.

An amount of the cross-linked silicone particles (D) with a particle diameter of 0.5 to 50 $\mu$m formulated into the ink-absorbing layer is 0.01 to 30 parts by weight, preferably 0.1 to 10 parts by weight, and more preferably 0.3 to 5 parts by weight per 100 parts by weight of the water soluble resin or water dispersible resin (A). The cross-linked silicone particles (D) of less than 0.01 parts by weight is not preferred since the effect of the cross-linked silicone particles is not attained. Meanwhile, the cross-linked silicone particles (D) of more than 30 parts by weight is not preferred as well since a printing property is deteriorated.

A formulating method for the cross-linked silicone particles (D) includes, for example, a method in which the particles are formulated in a coating liquid for forming the ink-absorbing layer to apply the resultant coating liquid to a substrate sheet and a method in which the silicone particles are sprayed after applying a coating liquid containing no particles to a substrate sheet.

Further, formulation of the phyllosilicate (E) modified by an organic treating agent (hereinafter referred to as an organic clay compound material) into the ink-absorbing layer improves a printing property. The phyllosilicate (or layered solicate) which is the raw material is phyllosilicate having a cation exchangeability and showing a specific property to swell by accepting water in an interface and includes smectite-type clay and swelling mica. The smectite-type clay includes natural or chemically synthesized products such as hectlite, saponite, stevensite, beidelite, montmorillonite, nontronite, and bentonite, or substitution products and derivatives thereof, and mixtures thereof. The swelling mica includes natural or chemically synthesized swelling micas having Li ions and Na ions in an interlayer, such as Li type fluorinated taeniorite, Na type fluorinated taeniorite, Na type tetrasilicon fluoride mica, and Li type tetrasilicon fluoride mica, or substitution products and derivatives thereof, and mixtures thereof. Further, vermiculite and fluorinated vermiculite can be used as well. The smectite-type clay and the swelling mica used in the present invention can be obtained according to the method described in JP-A-6-287014.

The organic treating agent used for the phyllosilicate includes a compound represented by the following Formula (1):

(1)

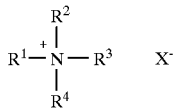

[wherein at least one of four substituents $R^1$ to $R^4$ is $(CH_2CH_2O)_nH$ or

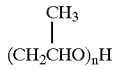

group (n is an integer of 1 to 50), and the remaining substituents are linear or branched alkyl group(s) having 1 to 10 carbon atoms, or hydrogen atom(s);

and $X^-$ is $Cl^-$, $Br^-$, $NO_3^-$, or $CH_3COO^-$.]

Among them, polyoxyethylenediethylmethylammonium chloride and polyoxypropylenediethylmethylammonium chloride are preferred, and polyoxypropylenediethylmethylammonium chloride is particularly preferred since it gives a large effect to a printing property.

A process for producing the organic clay compound material using the raw materials described above shall not specifically be restricted, and it can be produced with reference to the process described in JP-A-6-287014. The organic clay compound material used in the present invention has a particle diameter of 50 $\mu$m or less. The particle diameter larger than 50 $\mu$m is not preferred since it is not effective for a printing property.

An amount of the organic clay compound material compounded into the ink-absorbing layer is 0.01 to 50 parts by weight, preferably 0.1 to 30 parts by weight, and more preferably 0.5 to 20 parts by weight per 100 parts by weight of the water soluble resin or water dispersible resin (A). The sheet having a good printing property can be obtained without compounding the organic clay compound material into the ink-absorbing layer, but compounding the organic clay compound material falling in the range described above into the ink-absorbing layer is preferred since it further improves the printing property.

A compounding effect of the organic clay compound material is particularly notable to an ink using an acid dye. It is considered that because the organic treating agent is a cationic product, the organic clay compound material produces an ionic bond with an acid dye to strengthen the fixability.

Further, organic particles, hydrophobic organic particles, preservatives, defoaming agents, coating improvers, thickeners, antioxidants, UV absorbers, and wetting agents can be used as well in combination in the ink-absorbing layer in a range where transparency and a printing property are not damaged. The inorganic particles include, for example, silica, clay, talc, diatomaceous earth, calcium carbonate, barium sulfate, aluminum silicate, synthetic zeolite, alumina, alumina hydrate, zinc oxide, and mica. The hydrophobic organic particles include non-cross-linked products or cross-linked products such as (meth)acrylic resins, styrol resins, polyester resins, polyolefin resins, polyamide resins, and polycarbonate resins. A particle diameter thereof is preferably 0.01 to 100 $\mu$m, and a compounding amount thereof is 0.1 to 20 parts by weight, preferably 0.1 to 10 parts by weight per 100 parts by weight of the water soluble resin or water dispersible resin (A).

A thickness of the ink-absorbing layer shall not specifically be restricted and is 1 to 200 $\mu$m, preferably 5 to 100 $\mu$m.

The constitution of the recording sheet shall not specifically be restricted as far as the ink-absorbing layer is provided uppermost, and the ink-absorbing layer may be provided in a single layer on the substrate. Further, a layer comprising the water soluble resin or water dispersible resin (A) and the polyhydric alcohol (C) may be provided as an intermediate layer between the substrate sheet and the ink-absorbing layer, wherein a formulating ratio (A):(C) of the component (A) to the component (C) is 100:0 to 30 (ratio by weight). The intermediate layer provides primarily an effect as an adhesive layer for the substrate and the ink-absorbing layer while it is effective as well for absorbing a water-base ink.

The same materials as those described above can be used for the water soluble resin or water dispersible resin (A) and the polyhydric alcohol (C) which are used for the intermediate layer. The intermediate layer may be of two or more layers. Inorganic particles, organic particles, preservatives, defoaming agents, coating improvers, thickeners, antioxidants, and UV absorbers may be formulated into the intermediate layer in a range where transparency and a printing property are not damaged.

Methods for forming these ink-absorbing layer and intermediate layer shall not specifically be restricted. The compositions described above are dissolved in suitable solvents, and the solutions thus prepared are applied on a substrate by publicly known methods such as gravure coating, reverse coating, kiss coating, die coating, and bar coating, followed by promptly drying.

The coated film thicknesses of the intermediate layer and the ink-absorbing layer shall not specifically be restricted. From the viewpoint of a handling property, that of the intermediate layer is 1 to 50 $\mu$m, preferably 5 to 20 $\mu$m, and that of the ink-absorbing layer is 0.01 to 30 $\mu$m, preferably 0.5 to 10 $\mu$m.

The recording sheet of the present invention is improved in a wettability to a water-base ink and an ink-absorbing power by providing the ink-absorbing layer containing the specific surfactant and the water soluble resin or water dispersible resin and results in showing very excellent properties in a printing quality and a drying property after printing. This can preferably be used in uses such as recording films for ink jet printers, offset printing and flexographic press.

EXAMPLES

The present invention shall be explained below in detail with reference to examples.

First, measuring methods of various properties in the present invention shall be explained.

(1) Printing property

Picture patterns were printed on Mach Jet Printer MJ-700V2C manufactured by Epson Co., Ltd. to evaluate a printing quality and an ink-absorbing power (quick drying property) and judge a recording property in the following manner. The printing quality was evaluated by observing the picture patterns with naked eyes under a magnifying glass, and the ink-absorbing power was evaluated by a stain degree of the ink-absorbing layer with an ink, wherein the picture patterns were rubbed once with a finger immediately after printing.

Printing quality

◎: Very good (dots are uniform and sharp)

○: Good

Δ: A little inferior

X: Slobbery stain, repellence and blur are observed in dots

Ink-absorbing power

◎: Very good (ink-absorbing layer is not stained)

○: Good

Δ: A little inferior

X: Ink flows to stain the ink-absorbing layer (2) Adhesion (blocking property) between the sheets Two sheets were superposed so that the substrate sheet face of one sheet was put on the ink-absorbing layer of the other sheet. Then, a load of 1.8 g/cm$^2$ was applied thereon, and the sheets were left for standing at 40° C. and 80% RH for 10 hours. Thereafter, a peeling state of the two sheets was evaluated after peeling them off.

◎: No adhering was observed between the sheets

○: Little adhering was observed between the sheets

Δ: A little adhering was observed between the sheets

X: Adhering was observed between the sheets (3) Evaluation of transparency in using as an OHP sheet Various ink-absorbing layers were provided on a polyethylene terephthalate (PET) substrate having a thickness of 100 μm. This substrate was measured for a light transmittance in a wavelength of 700 nm by means of a Shimadzu automatic spectrophotometer UV-265FW. A light transmittance of the PET film alone was 88%.

◎: Light transmittance: 80% or more

○: Light transmittance: 75% or more and less than 80%

X: Light transmittance: less than 75%

Examples 1 to 4

Coating liquids having the following compositions were applied on one face of a polyethylene terephthalate film (Melinex #705 having a thickness of 100 μm, manufactured by ICI Japan Co., Ltd.) and dried by applying hot air at 120° C. for 5 minutes, whereby coated films having a thickness of about 20 μm were formed. The recording characteristics of the recording sheets comprising these components are shown in Table 1. The upper layer means the ink-absorbing layer.

Example 1

| | |
|---|---|
| Intermediate layer: | |
| Polyvinyl alcohol (PVA217 manufactured by Kuraray Co., Ltd., saponification degree: about 88%, average polymerization degree: about 1700) | 10.0 g |
| Deionized water | 90.0 g |
| Coated film thickness of the intermediate layer | 15.0 μm |
| Upper layer: | |
| Polyvinyl alcohol (PVA217 manufactured by Kuraray Co., Ltd.) | 10.0 g |
| Polyoxyethylenesorbitan monopalmitate (Rheodol Tw-P120 manufactured by Kab Co., Ltd., HLB: 15.6) | 1.2 g |
| Deionized water | 88.8 g |
| Coated film thickness of the upper layer | 5.0 μm |

Example 2

| | |
|---|---|
| Intermediate layer: | |
| Polyvinyl alcohol (PVA235 manufactured by Kuraray Co., Ltd., saponification degree: about 88%, average polymerization degree: about 1700) | 10.0 g |
| Deionized water | 90.0 g |
| Coated film thickness of the intermediate layer | 13.0 μm |
| Upper layer: | |
| Polyvinyl alcohol (PVA235 manufactured by Kuraray Co., Ltd.) | 10.0 g |
| Polyoxyethylenesorbitan monostearate (Rheodol TW-S120 manufactured by Kao Co., Ltd., HLB: 14.9) | 1.8 g |
| Deionized water | 88.2 g |
| Coated film thickness of the upper layer | 1.5 μm |

Example 3

| | |
|---|---|
| Intermediate layer: | |
| Hydroxypropyl cellulose (SSL manufactured by Nippon Soda Co., Ltd.) | 10.0 g |
| Deionized water | 90.0 g |
| Coated film thickness of the intermediate layer | 20.0 μm |
| Upper layer: | |
| Polyvinyl alcohol (PVA217 manufactured by Kuraray Co., Ltd.) | 10.0 g |
| Polyoxyethylenesorbitan trioleate (Rheodol TW-0320 manufactured by Kao Co., Ltd., HLB: 11.0) | 0.7 g |
| Deionized water | 89.3 g |
| Coated film thickness of the upper layer | 3.0 μm |

Example 4

| | |
|---|---|
| Intermediate layer: | |
| Polyvinyl alcohol (PVA217 manufactured by Kuraray Co., Ltd.) | 10.0 g |
| Deionized water | 90.0 g |
| Coated film thickness of the intermediate layer | 15.0 μm |
| Upper layer: | |
| Polyvinyl alcohol (PVA217 manufactured by Kuraray Co., Ltd.) | 10.0 g |
| Polyoxyethylenesorbitan monopalmitate (Rheodol TW-P120 manufactured by Kao Co., Ltd., HLB: 15.6) | 1.2 g |
| Polyoxypropylenediethylmethylammonium chloride-modified smectite (prepared according to Example 1 in JP-A-6-287014, and after coating, the average particle diameter was measured under a transmission type electron microscope: about 0.12 μm) | 0.1 g |
| Deionized water | 88.7 g |
| coated film thickness of the upper layer | 5.0 μm |

Comparative Examples 1 to 6

Coating liquids having the following compositions were applied on one face of a polyethylene terephthalate film (Melinex #705 having a thickness of 100 μm, manufactured by ICI Japan Co., Ltd.) and dried by applying hot air at 120° C. for 5 minutes, whereby coated films having a thickness of 20 μm were formed. The recording characteristics of the recording sheets comprising these components are shown in Table 1. The upper layer means the ink-absorbing layer.

Comparative Example 1

| | |
|---|---|
| Single layer: | |
| Polyvinyl alcohol (PVA217 manufactured by Kuraray Co., Ltd.) | 10.0 g |
| Deionized water | 90.0 g |
| Coated film thickness of the single layer | 20.0 μm |

Comparative Example 2

| | |
|---|---|
| Intermediate layer: | |
| Polyvinyl alcohol (PVA217 manufactured by Kuraray Co., Ltd.) | 10.0 g |
| Deionized water | 90.0 g |
| Coated film thickness of the intemediate layer | 15.0 μm |
| Upper layer: | |
| Polyvinyl alcohol (PVA217 manufactured by Kuraray Co., Ltd.) | 10.0 g |
| Polyoxyethylene lauryl ether (Emulgen 108 manufactured by Kao Co., Ltd., HLB: 12.1) | 1.5 g |
| Deionized water | 88.5 g |
| Coated film thickness of the upper layer | 5.0 μm |

Comparative Example 3

| | |
|---|---|
| Intermediate layer: | |
| Polyvinyl alcohol (PVA217 manufactured by Kuraray Co., Ltd.) | 10.0 g |
| Deionized water | 90.0 g |
| Coated film thickness of the intermediate layer | 15.0 μm |
| Upper layer: | |
| Polyvinyl alcohol (PVA217 manufactured by Kuraray Co., Ltd.) | 10.0 g |
| Lauryltrimethylammonium chloride (Coatamine 24P manufactured by Kao Co., Ltd.) | 1.2 g |
| Deionized water | 55.5 g |
| Coated film thickness of the upper layer | 5.0 μm |

Comparative Example 4

| | |
|---|---|
| Intermediate layer: | |
| Polyvinyl alcohol (PVA217 manufactured by Kuraray Co., Ltd.) | 10.0 g |
| Deionized water | 90.0 g |
| Coated film thickness of the intermediate layer | 15.0 μm |
| Upper layer: | |
| Polyvinyl alcohol (PVA217 manufactured by Kuraray Co., Ltd.) | 10.0 g |
| Laurylbetain (Amphitol 24B manufactured by Kao Co., Ltd.) | 1.2 g |
| Deionized water | 88.8 g |
| Coated film thickness of the upper layer | 5.0 μm |

Comparative Example 5

| | |
|---|---|
| Intermediate layer: | |
| Polyvinyl alcohol (PVA217 manufactured by Kuraray Co., Ltd.) | 10.0 g |
| Deionized water | 90.0 g |
| Coated film thickness of the intermediate layer | 15.0 μm |
| Upper layer: | |
| Polyvinyl alcohol (PVA217 manufactured by Kuraray Co., Ltd.) | 10.0 g |
| Polyoxyethylenesorbitan monopalmitate (Rheodol TW-P120 manufactured by Kao Co., Ltd., HLB: 15.6) | 5.0 g |
| Deionized water | 85.0 g |
| Coated film thickness of the upper layer | 5.0 μm |

Comparative Example 6

| | |
|---|---|
| Intermediate layer: | |
| Polyvinyl alcohol (PVA217 manufactured by Kuraray Co., Ltd.) | 10.0 g |
| Deionized water | 90.0 g |
| Coated film thickness of the intermediate layer | 15.0 μm |

-continued

| | |
|---|---|
| Upper layer: | |
| Polyvinyl alcohol (PVA217 manufactured by Kuraray Co., Ltd.) | 10.0 g |
| Polyoxyethylenesorbitan monopalmitate (Rheodol TW-P120 manufactured by Kao Co., Ltd., HLB: 15.6) | 0.0005 g |
| Deionized water | 89.9995 g |
| Coated film thickness of the upper layer | 5.0 μm |

-continued

| | |
|---|---|
| Co., Ltd., HLB: 15.6) | |
| Deionized water | 89.5 g |

Example 6

| | |
|---|---|
| Partially saponified polyvinyl alcohol (PVA417 manufactured by Kuraray Co., | 10.0 g |

TABLE 1

| | Materials for ink-absorbing layer | Transparency (transmittance) | Printing quality | Ink absorbing power | Adhesion between sheets |
|---|---|---|---|---|---|
| Example 1 | Intermediate layer: polyvinyl alcohol<br>Upper layer: polyvinyl alcohol + polyoxyethylenesorbitan monopalmitate | ⊚ (83%) | ○ | ⊚ | Δ |
| Example 2 | Intermediate layer: polyvinyl alcohol<br>Upper layer: polyvinyl alcohol + polyoxyethylenesorbitan monostearate | ○ (77%) | ○ | ⊚ | Δ |
| Example 3 | Intermediate layer: hydroxypropyl cellulose<br>Upper layer: polyvinyl alcohol + polyoxyethylenesorbitan trioleate | ○ (78%) | ○ | ⊚ | Δ |
| Example 4 | Intermediate layer: polyvinyl alcohol<br>Upper layer: polyvinyl alcohol + polyoxyethylenesorbitan monopalmitate + polyoxypropyldiethylmethylammonium chloride-modified smectite clay | ⊚ (83%) | ⊚ | ⊚ | Δ |
| Comparative Example 1 | Intermediate layer: polyvinyl alcohol | ⊚ (87%) | Δ | Δ | Δ |
| Comparative Example 2 | Intermediate layer: polyvinyl alcohol<br>Upper layer: polyvinyl alcohol + polyoxyethylene lauryl ether | ○ (77%) | Δ | Δ | Δ |
| Comparative Example 3 | Intermediate layer: polyvinyl alcohol<br>Upper layer: polyvinyl alcohol + lauryltrimethylammonium chloride | ○ (76%) | x | Δ | Δ |
| Comparative Example 4 | Intermediate layer: polyvinyl alcohol<br>Upper layer: polyvinyl alcohol + laurylbetain | ○ (76%) | x | Δ | Δ |
| Comparative Example 5 | Intermediate layer: polyvinyl alcohol<br>Upper layer: polyvinyl alcohol + polyoxyethylenesorbitan monopalmitate | ○ (75%) | x | x | x |
| Comparative Example 6 | Intermediate layer: polyvinyl alcohol<br>Upper layer: polyvinyl alcohol + polyoxyethylenesorbitan monopalmitate | ⊚ (85%) | Δ | Δ | Δ |

Examples 5 to 11

Coating liquids having the following compositions were applied on one face of a polyethylene terephthalate film (Melinex #705 having a thickness of 100 μm, manufactured by ICI Japan Co., Ltd.) and dried by applying hot air at 120° C. for 5 minutes, whereby coated films having a thickness of 10 μm were formed. The recording characteristics of the recording sheets comprising these components are shown in Table 2.

Example 5

| | |
|---|---|
| Partially saponified polyvinyl alcohol (PVA417 manufactured by Kuraray Co., Ltd., saponification degree: about 78%, average polymerization degree: about 1700) | 10.0 g |
| Polyoxyethylenesorbitan monopalmitate (Rheodol TW-P120 manufactured by Kao | 0.5 g |

-continued

| | |
|---|---|
| Ltd., saponification degree: about 88%, average polyerization degree: about 1700) | |
| Polyoxyethylenesorbitan monostearate (Rheodol TW-S120 manufactured by Kao Co., Ltd., HLB: 14.9) | 1.2 g |
| Deionized water | 88.8 g |

Example 7

| | |
|---|---|
| Cation-modified polyvinyl alcohol (PVA C-318 manufactured by Kuraray Co., Ltd., saponification degree: about 88%, cation modification degree: about 0.2%, average polyerization degree: about 1800) | 10.0 g |
| Polyoxyethylenesorbitan monopalinitate (Rheodol TW-P120 manufactured by Kao | 0.2 g |

-continued

| | |
|---|---|
| Co., Ltd., HLB: 15.6) | |
| Deionized water | 89.8 g |

Example 8

| | |
|---|---|
| Cation-modified polyvinyl alcohol (PVA CM-318 manutactured by Kuraray Co., Ltd., saponification degree: about 88%, cation modification degree: about 2%, average polymerization degree: about 1800) | 10.0 g |
| Polyoxyethylenesorbitan trioleate (Rheodol TW-0320 manufactured by Kao Co., Ltd., HLB: 11.0) | 0.7 g |
| Deionized water | 89.3 g |

Example 9

| | |
|---|---|
| Partially saponified polyvinyl alcohol (PVA417 manufactured by Kuraray Co., Ltd.) | 10.0 g |
| Polyoxyethylenesorbitan monopalmitate (Rheodol TW-P120 manufactured by Kao Co., Ltd.) | 0.3 g |
| Polyoxypropylenediethylmethylammonium chloride-modified smectite (prepared according to Example 1 in JP-A-6-287014, and after coating, the average particle diameter was measured under a transmission type electron microscope: about 0.12 μm) | 0.1 g |
| Deionized water | 89.6 g |

Example 10

| | |
|---|---|
| Partially saponified polyvinyl alcohol (PVA417 manufactured by Kuraray Co., Ltd.) | 10.0 g |
| Polyoxyethylenesorbitan monopalinitate (Rheodol TW-P120 manufactured by Kao Co., Ltd.) | 0.3 g |
| Glycerol | 0.2 g |
| Deionized water | 89.5 g |

Example 11

| | |
|---|---|
| Partially saponified polyvinyl alcohol (PVA417 manufactured by Kuraray Co., Ltd.) | 10.0 g |
| Polyoxyethylenesorbitan monopalmitate (Rheodol TW-P120 manufactured by Kao Co., Ltd.) | 0.3 g |
| Polyoxypropylenediethylmethylammonium chloride-modified smectite (prepared according to Example 1 in JP-A-6-287014, and after coating, the average particle diameter was measured under a transmission type electron microscope: about 0.12 μm) | 0.1 g |
| Glycerol | 0.2 g |
| Deionized water | 89.4 g |

Comparative Examples 7 to 13

Coating liquids having the following compositions were applied on one face of a polyethylene terephthalate film (Melinex #705 having a thickness of 100 μm, manufactured by ICI Japan Co., Ltd.) and dried by applying hot air at 120° C. for 5 minutes, whereby coated films having a thickness of 10 μm were formed. The recording characteristics of the recording sheets comprising these components are shown in Table 2.

Comparative Example 7

| | |
|---|---|
| Partially saponified polyvinyl alcohol (PVA417 manufactured by Kuraray Co., Ltd.) | 10.0 g |
| Deionized water | 90.0 g |

Comparative Example 8

| | |
|---|---|
| Cation-modified polyvinyl alcohol (PVA C-318 manufactured by Kuraray Co., Ltd.) | 10.0 g |
| Deionized water | 90.0 g |

Comparative Example 9

| | |
|---|---|
| Partially saponified polyvinyl alcohol (PVA417 manufactured by Kuraray Co., Ltd.) | 10.0 g |
| Polyoxyethylene lauryl ether (Emulgen 108 manufactured by Kao Co., Ltd., HLB: 12.1) | 1.0 g |
| Deionized water | 89.0 g |

Comparative Example 10

| | |
|---|---|
| Partially saponified polyvinyl alcohol (PVA217 manufactured by Kuraray Co., Ltd.) | 10.0 g |
| Lauryltrimethylammmonium chloride (Coatamine 24P manufactured by Kao Co., Ltd.) | 1.0 g |
| Deionized water | 89.0 g |

Comparative Example 11

| | |
|---|---|
| Cation-modified polyvinyl alcohol (PVA C-318 manufactured by Kuraray Co., Ltd.) | 10.0 g |
| Laurylbetain (Amphitol 24B manufactured by Kao Co., Ltd.) | 1.0 g |
| Deionized water | 89.0 g |

Comparative Example 12

| | |
|---|---|
| Partially saponified polyvinyl alcohol (PVA417 manufactured by Kuraray Co., Ltd.) | 10.0 g |
| Polyoxyethylenesorbitan monopalmitate (Rheodol TW-P120 manufactured by Kao Co., Ltd.) | 0.0005 g |
| Deionized water | 89.9995 g |

Comparative Example 13

| | |
|---|---|
| Partially saponified polyvinyl alcohol (PVA417 manufactured by Kuraray Co., Ltd.) | 10.0 g |
| Polyoxyethylenesorbitan monopalmitate (Rheodol TW-P120 manufactured by Kao | 5.0 g |

-continued

| | |
|---|---|
| Co., Ltd.) | |
| Deionized water | 85.0 g |

-continued

| | |
|---|---|
| Polyoxyethylene monolaurate (Emanon 1112 manufactured by Kao Co., Ltd., HLB: 13.7) | 0.3 g |

TABLE 2

| | Materials for ink-absorbing layer | Transparency (transmittance) | Printing quality | Ink absorbing power | Adhesion between sheets |
|---|---|---|---|---|---|
| Example 5 | Partially saponified polyvinyl alcohol (PVA417) + polyoxyethylenesorbitan monopalmitate | ⊙ (82%) | ○ | ⊙ | Δ |
| Example 6 | Partially saponified polyvinyl alcohol (PVA217) + polyoxyethylenesorbitan monostearate | ○ (78%) | ○ | ⊙ | Δ |
| Example 7 | Cation-modified polyvinyl alcohol (PVA C-318) + polyoxyethylenesorbitan monopalmitate | ⊙ (84%) | ○ | ⊙ | Δ |
| Example 8 | Cation-modified polyvinyl alcohol (PVA CM-318) + polyoxyethylenesorbitan trioleate | ○ (77%) | ○ | ⊙ | Δ |
| Example 9 | Partially saponified polyvinyl alcohol (PVA417) + polyoxyethylenesorbitan monopalmitate + polyoxypropylene-diethylmethylammonium chloride-modified smectite clay | ⊙ (83%) | ⊙ | ⊙ | Δ |
| Example 10 | Partially saponified polyvinyl alcohol (PVA417) + polyoxyethylenesorbitan monopalmitate + glycerol | ⊙ (84%) | ⊙ | ⊙ | Δ |
| Example 11 | Partially saponified polyvinyl alcohol (PVA417) + polyoxyethylenesorbitan monopalmitate + polyoxypropylene-diethylmethylammonium chloride-modified smectite clay + glycerol | ⊙ (83%) | ⊙ | ⊙ | Δ |
| Comparative Example 7 | Partially saponified polyvinyl alcohol (PVA417) | ⊙ (87%) | Δ | Δ | Δ |
| Comparative Example 8 | Cation-modified polyvinyl alcohol (PVA C-318) | ⊙ (86%) | Δ | Δ | Δ |
| Comparative Example 9 | Partially saponified polyvinyl alcohol (PVA417)) + polyoxyethylene lauryl ether | ○ (75%) | x | x | Δ |
| Comparative Example 10 | Partially saponified polyvinyl alcohol (PVA217) + lauryltrimethyl-ammonium chloride | ○ (76%) | x | x | Δ |
| Comparative Example 11 | Cation-modified polyvinyl alcohol (PVA C-318) + laurylbetain | ○ (75%) | x | x | Δ |
| Comparative Example 12 | Partially saponified polyvinyl alcohol (PVA417)) + polyoxy-ethylenesorbitan monopalmitate | ⊙ (85%) | Δ | Δ | Δ |
| Comparative Example 13 | Partially saponified polyvinyl alcohol (PVA417)) + polyoxy-ethylenesorbitan monopalmitate | ○ (75%) | x | x | x |

Examples 12 to 14

Coating liquids having the following compositions were applied on one face of a polyethylene terephthalate film (Melinex #705 having a thickness of 100 μm, manufactured by ICI Japan Co., Ltd.) and dried by applying hot air at 120° C. for 5 minutes, whereby coated films having a thickness of 10 μm were formed. The recording characteristics of the recording sheets comprising these components are shown in Table 3.

Example 12

| | |
|---|---|
| Partially saponified polyvinyl alcohol (PVA217 manufactured by Kuraray Co., Ltd., saponification degree: about 88%, average polymerization degree: about 1700) | 10.0 g |

-continued

| | |
|---|---|
| Glycerol | 0.7 g |
| Deionized water | 89.0 g |

Example 13

| | |
|---|---|
| Partially saponified polyvinyl alcohol (PVA417 manufactured by Kuraray Co., Ltd., saponification degree: about 78%, average polymerization degree: about 1700) | 10.0 g |
| Polyoxyethylene monooleate (Emanon 4110 manufactured by Kao Co., Ltd., HLB: 11.6) | 0.4 g |
| Ethylene glycol | 0.1 g |
| Deionized water | 89.5 g |

Example 14

| | |
|---|---|
| Partially saponified polyvinyl alcohol (PVA217 manufactured by Kuraray Co., Ltd.) | 10.0 g |
| Polyoxyethylene monolaurate (Emanon 1112 manufactured by Kao Co., Ltd.) | 0.3 g |
| Glycerol | 0.7 g |
| Polyoxypropylenediethylmethylammonium chloride-modified smectite (prepared according to Example 1 in JP-A-6-287014, and after coating, the average particle diameter was measured under a transmission type electron microscope: about 0.12 μm) | 0. 1 g |
| Deionized water | 88.9 g |

Comparative Examples 14 to 17

Coating liquids having the following compositions were applied on one face of a polyethylene terephthalate film (Melinex #705 having a thickness of 100 μm, manufactured by ICI Japan Co., Ltd.) and dried by applying hot air at 120° C. for 5 minutes, whereby coated films having a thickness of 10 μm were formed. The recording characteristics of the recording sheets comprising these components are shown in Table 3.

Comparative Example 14

| | |
|---|---|
| Partially saponified polyvinyl alcohol (PVA217 manufactured by Kuraray Co., Ltd.) | 10.0 g |
| Polyoxyethylene lauryl ether (Emulgen 108 manufactured by Kao Co., Ltd., HLB: 12.1) | 1.0 g |
| Glycerol | 0.7 g |
| Deionized water | 88.3 g |

Comparative Example 15

| | |
|---|---|
| Cation-modified polyvinyl alcohol (PVA C-318 manufactured by Kuraray Co., Ltd.) | 10.0 g |
| Laurylbetain (Amphitol 24B manufactured by Kao Co., Ltd.) | 1.0 g |
| Ethylene glycol | 0.5 g |
| Deionized water | 88.5 g |

Comparative Example 16

| | |
|---|---|
| Partially saponified polyvinyl alcohol (PVA217 manufactured by Kuraray Co., Ltd.) | 10.0 g |
| Polyoxyethylene monolaurate (Emanon 1112 manufactured by Kao Co., Ltd.) | 0.0005 g |
| Glycerol | 0.7 g |
| Dionized water | 89.2995 g |

Comparative Example 17

| | |
|---|---|
| Partially saponified polyvinyl alcohol (PVA217 manufactured by Kuraray Co., Ltd.) | 10.0 g |
| Polyoxyethylene monolaurate (Emanon 1112 manufactured by Kao Co., Ltd.) | 5.0 g |
| Glycerol | 0.7 g |
| Deionized water | 84.3 g |

TABLE 3

| | Materials for ink-absorbing layer | Transparency (transmittance) | Printing quality | Ink absorbing power | Adhesion between sheets |
|---|---|---|---|---|---|
| Example 12 | Partially saponified polyvinyl alcohol (PVA217) + polyoxyethylene monolaurate + glycerol | ⊙ (83%) | ○ | ⊙ | Δ |
| Example 13 | Partially saponified polyvinyl alcohol (PVA417) + polyoxyethylene monooleate + ethylene glycol | ○ (77%) | ○ | ⊙ | Δ |
| Example 14 | Partially saponified polyvinyl alcohol (PVA217) + polyoxyethylene monolaurate + glycerol + polyoxypropylenediethyl-methylammonium chloride-modified smectite clay | ⊙ (81%) | ⊙ | ⊙ | Δ |
| Comparative Example 14 | Partially saponified polyvinyl alcohol (PVA217) + polyoxyethylene lauryl ether + glycerol | ⊙ (82%) | x | x | Δ |
| Comparative Example 15 | Cation-modified polyvinyl alcohol (PVA C-318) + laurylbetain + ethylene glycol | ○ (75%) | x | x | Δ |
| Comparative Example 16 | Partially saponified polyvinyl alcohol (PVA217) + polyoxyethylene monolaurate + glycerol | ⊙ (86%) | Δ | Δ | Δ |
| Comparative Example 17 | Partially saponified polyvinyl alcohol (PVA217) + polyoxyethylene monolaurate + glycerol | x (72%) | x | x | Δ |

Examples 15 to 36

Coating liquids having the following compositions were applied on one face of a polyethylene terephthalate film (#D535 having a thickness of 100 μm, manufactured by ICI Japan Co., Ltd.) and dried by applying hot air at 120° C. for 5 minutes, whereby coated films having a thickness of 15 μm were formed. The recording characteristics of the recording sheets comprising these components are shown in Table 4.

Example 15

| | |
|---|---|
| Partially saponified polyvinyl alcohol (PVA417 manufactured by Kuraray Co., Ltd., saponification degree: about 78%, average polymerization degree: about 1700) | 10.0 g |
| Decaglycerin caprylate (MCA-750 manufactured by Sakamoto Yakuhin Ind. Co., Ltd., HLB: 16) | 0.5 g |
| Deionized water | 89.5 g |

Example 16

| | |
|---|---|
| Cation-modified polyvinyl alcohol (PVA CM-318 manufactured by Kuraray Co., Ltd., saponification degree: about 88%, cation modification degree: about 2%, average polymerization degree: about 1800) | 10.0 g |
| Polyoxyethylenesorbitan monopalmitate (Rheodol TW-P120 manufactured by Kao Co., Ltd., HLB: 15.6) | 1.2 g |
| Deionized water | 88.8 g |

Example 17

| | |
|---|---|
| Partially saponified polyvinyl alcohol (PVA417 manufactured by Kuraray. Co., Ltd.) | 10.0 g |
| Decaglycerin caprylate (MCA-750 manufactured by Sakamoto Yakuhin Ind. Co., Ltd., HLB: 16) | 0.5 g |
| Glycerol (refined glycerol manufactured Kao Co., Ltd.) | 0.5 g |
| Deionized water | 89.0 g |

Example 18

| | |
|---|---|
| Cation-modified polyvinyl alcohol (PVA CM-318 manufactured by Kuraray Co., Ltd.) | 10.0 g |
| Polyoxyethylene monolaurate (Emanon 1112 manufactured by Kao Co., Ltd., HLB: 13.7) | 0.1 g |
| Ethylene glycol (manufactured by Wako Junyaku Co., Ltd.) | 1.2 g |
| Deionized water | 88.7 g |

Example 19

| | |
|---|---|
| Partially saponified polyvinyl alcohol (PVA217 manufactured by Kuraray Co., Ltd., saponification degree: about 88%, average polymerization degree: about 1700) | 10.0 g |

-continued

| | |
|---|---|
| Decaglycerin caplyrate (MCA-750 manufactured by Sakamoto Yakuhin Ind. Co., Ltd.) | 0.7 g |
| Decaglycerin | 0.1 g |
| Deionized water | 89.2 g |

Example 20

| | |
|---|---|
| Partially saponified polyvinyl alcohol (PVA417 manufactured by Kuraray Co., Ltd.) | 10.0 g |
| Decaglycerin caprylate (MCA-750 manufactured by Sakamoto Yakuhin Ind. Co., Ltd.) | 0.5 g |
| Silicone particles (Tospearl 3120 manufactured by Toshiba Silicone Co., Ltd., average particle diameter: about 18 μm) | 0.05 g |
| Deionized water | 89.45 g |

Example 21

| | |
|---|---|
| Partially saponified polyvinyl alcohol (PVA217 manufactured by Kuraray Co., Ltd.) | 8.0 g |
| Sodium alginate (manufactured by Nakarai Chemical Co., Ltd., 100 cps) | 2.0 g |
| Decaglycerin monolaurate (ML-750 manufactured by Sakamoto Yakuhin Ind. Co., Ltd., HLB: 15) | 0.6 g |
| Silicone particles (Tospearl 5H08 manufactured by Toshiba Silicone Co., Ltd., average particie diameter: about 6.5 μm) | 1.0 g |
| Deionized water | 88.4 g |

Example 22

| | |
|---|---|
| Partially saponified polyvinyl alcohol (PVA417 manufactured by Kuraray Co., Ltd.) | 10.0 g |
| Polyoxyethylene monolaurate (Emanon 1112 manufactured by Kao Co., Ltd.) | 0.1 g |
| Silicone particles (Tospearl 3120 manufactured by Toshiba Silicone Co., Ltd.) | 0.02 g |
| Deionized water | 89.88 g |

Example 23

| | |
|---|---|
| Partially saponified polyvinyl alcohol (PVA417 manutactured by Kuraray Co., Ltd.) | 10.0 g |
| Decaglycerin caprylate (MCA-750 manufactured by Sakamoto Yakuhin Ind. Co., Ltd.) | 0.5 g |
| Glycerol (refined glycerol manufactured Kao Co., Ltd.) | 0.5 g |
| Silicone particles (Tospearl 3120 manufactured by Toshiba Silicone Co., Ltd.) | 0.05 g |
| Deionized water | 88.95 g |

Example 24

| | |
|---|---|
| Partially saponified polyvinyl alcohol (PVA217 manufactured by Kuraray Co., Ltd.) | 10.0 g |
| Decaglycerin monolaurate (ML-750 manufactured by Sakamoto | 1.0 g |

-continued

| | |
|---|---|
| Yakuhin Ind. Co., Ltd., HLB: 15) | |
| Hexaglycerin (polyglycerin #500 manutactured Sakamoto Yakuhin Ind. Co., Ltd.) | 0.3 g |
| Silicone particles (Tospearl 3120 manutactured by Toshiba Silicone Co., Ltd.) | 0.06 g |
| Deionized water | 88.64 g |

Example 25

| | |
|---|---|
| Cation-modified polyvinyl alcohol (PVA CM-318 manufactured by Kuraray Co., Ltd.) | 10.0 g |
| Polyoxyethylene monolaurate (Emanon 1112 manufactured by Kao Co., Ltd.) | 0.1 g |
| Ethylene glycol (manufactured by Wako Junyaku Co., Ltd.) | 0.5 g |
| Silicone particles (Tospearl 5H08 manufactured by Toshiba Silicone Co., Ltd.) | 0.1 g |
| Deionized water | 89.3 g |

Example 26

| | |
|---|---|
| Partially saponified polyvinyl alcohol (PVA217 manufactured by Kuraray Co., Ltd.) | 10.0 g |
| Polyoxyethylenesorbitan monopalmitate (Rheodol TW-P120 manufactured by Kao Co., Ltd., HLB: 15.6) | 0.8 g |
| Polyoxypropylenediethylmethylammonium chloride-modified smectite (prepared according to Example 1 in JP-A-6-287014, and after coating, the average particle diameter was measured under a transmission type electron microscope: about 0.12 μm) | 0.01 g |
| Deionized water | 89.19 g |

Example 27

| | |
|---|---|
| Partially saponified polyvinyl alcohol (PVA417 manufactured by Kuraray Co., Ltd.) | 10.0 g |
| Decaglycerin caprylate (MCA-750 manufactured by Sakamoto Yakuhin Ind. Co., Ltd.) | 1.0 g |
| Polyoxypropylenediethylmethylammonium chloride-modified smectite (prepared according to Example 1 in JP-A-6-287014, and after coating, the average particle diameter was measured under a transmission type electron microscope: about 0.12 μm) | 0.1 g |
| Deionized water | 88.9 g |

Example 28

| | |
|---|---|
| Partially saponified polyvinyl alcohol (PVA417 manufactured by Kuraray Co., Ltd.) | 10.0 g |
| Polyoxyethylenesorbitan monopalmitate (Rheodol TW-P120 manufactured by Kao Co., Ltd., HLB: 15.6) | 0.8 g |
| Glycerol (refined glycerol manufactured Kao Co., Ltd.) | 0.5 g |
| Polyoxypropylenediethylmethylammonium chloride-modified smectite (prepared according to Example 1 in JP-A-6-287014, and after coating, the average particle diameter was measured under a transmission type electron microscope: about 0.12 μm) | 0.01 g |
| Deionized water | 88.66 g |

Example 29

| | |
|---|---|
| Partially saponified polyvinyl alcohol (PVA417 manufactured by Kuraray Co., Ltd.) | 10.0 g |
| Decaglycerin caprylate (MCA-750 manufactured by Sakamoto Yakuhin Ind. Co., Ltd.) | 1.0 g |
| Ethylene glycol (manufactured by Wako Junyaku Co. Ltd.) | 0.2 g |
| Polyoxypropylenediethylmethylammonium chloride-modified smectite (prepared according to Example 1 in JP-A-6-287014, and after coating, the average particle diameter was measured under a transmission type electron microscope: about 0.12 μm) | 0.01 g |
| Deionized water | 88.79 g |

Example 30

| | |
|---|---|
| Partially saponified polyvinyl alcohol (PVA417 manufactured by Kuraray Co., Ltd.) | 10.0 g |
| Polyoxyethylenesorbitan monopalmitate (Rheodol TW-P120 manufactured by Kao Co., Ltd., HLB: 15.6) | 0.8 g |
| Silicone particles (Tospearl 3120 manufactured by Toshiba Silicone Co., Ltd.) | 0.05 g |
| Polyoxypropylenediethyimethylammonium chloride-modified smectite (prepared according to Example 1 in JP-A-6-287014, and after coating, the average particle diameter was measured under a transmission type electron microscope: about 0.12 μm) | 0.01 g |
| Deionized water | 89.14 g |

Example 31

| | |
|---|---|
| Partially saponified polyvinyl alcohol (PVA417 manufactured by Kuraray Co., Ltd.) | 10.0 g |
| Decaglycerin caprylate (MCA-750 manufactured by Sakamoto Yakuhin Ind. Co., Ltd.) | 1.0 g |
| Silicone particles (Tospearl 3120 manufactured by Toshiba Silicone Co., Ltd.) | 0.05 g |
| Polyoxypropylenediethylmethylammonium chloride-modified smectite (prepared according to Example 1 in JP-A-6-287014, and after coating, the average particle diameter was measured under a transmission type electron microscope: about 0.12 μm) | 0.01 g |
| Deionized water | 88.94 g |

Example 32

| | |
|---|---|
| Cation-modified polyvinyl alcohol (PVA CM-318 manufactured by Kuraray Co., Ltd.) | 10.0 g |
| Decaglycerin caprylate | 1.0 g |

-continued

| | |
|---|---|
| (MCA-750 manufactured by Sakamoto Yakuhin Ind. Co., Ltd.) | |
| Glycerol (refined glycerol manufactured Kao Co., Ltd.) | 0.5 g |
| Silicone particles (Tospearl 3120 manufactured by Toshiba Silicone Co., Ltd.) | 0.05 g |
| Polyoxypropylenediethylmethylammonium chloride-modified smectite (prepared according to Example 1 in JP-A-6-287014, and after coating, the average particle diameter was measured under a transmission type electron microscope: about 0.12 μm) | 0.01 g |
| Deionized water | 88.44 g |

Example 33

| | |
|---|---|
| Partially saponified polyvinyl alcohol (PVA417 manufactured by Kuraray Co., Ltd.) | 10.0 g |
| Decaglycerin caprylate (MCA-750 manufactured by Sakamoto Yakuhin Ind. Co., Ltd.) | 1.0 g |
| Ethylene glycol (manufactured by Wako Junyaku Co., Ltd.) | 0.2 g |
| Silicone particles (Tospearl 3120 manufactured by Toshiba Silicone Co., Ltd.) | 0.05 g |
| Polyoxypropylenediethylmethylammonium chloride-modified smectite (prepared according to Example 1 in JP-A-6-287014, and after coating, the average particle diameter was measured under a transmission type electron microscope: about 0.12 μm) | 0.05 g |
| Deionized water | 88.7 g |

Example 34

| | |
|---|---|
| Partially saponified polyvinyl alcohol (PVA417 manufactured by Kuraray Co., Ltd.) | 10.0 g |
| Polyoxyethylenesorbitan monopalmitate (Rheodol TW-P120 manufactured by Kao Co., Ltd., HLB: 15.6) | 0.1 g |
| Glycerol (refined glycerol manufactured Kao Co., Ltd.) | 1.0 g |
| Silicone particles (Tospearl 3120 manufactured by Toshiba Silicone Co., Ltd.) | 0.05 g |
| Polyoxypropylenediethylmethylammonium chloride-modified smectite (prepared according to Example 1 in JP-A-6-287014, and after coating, the average particle diameter was measured under a transmission type electron microscope: about 0.12 pm) | 0.01 g |
| Deionized water | 88.84 g |

Example 35

| | |
|---|---|
| Intermediate layer: | 10 μm |
| Partially saponified polyvinyl alcohol (PVA217 manufactured by Kuraray Co., Ltd.) | 10.0 g |
| Deionized water | 90.0 g |
| Ink-absorbing layer: | 5 μm |
| Partially saponified polyvinyl alcohol (PVA417 manufactured by Kuraray Co., Ltd.) | 10.0 g |
| Decaglycerin caprylate (MCA-750 manufactured by Sakamoto Yakuhin Ind. Co., Ltd.) | 0.5 g |
| Glycerol (refined glycerol manufactured Kao Co., Ltd.) | 0.5 g |

-continued

| | |
|---|---|
| Silicone particles (Tospearl 3120 manufactured by Toshiba Silicone Co., Ltd.) | 0.05 g |
| Deionized water | 88.95 g |

Example 36

| | |
|---|---|
| Intermediate layer: | 10 μm |
| Partially saponified polyvinyl alcohol (PVA417 manufactured by Kuraray Co., Ltd.) | 10.0 g |
| Glycerol (retined glycerol manufactured Kao Co., Ltd.) | 7.0 g |
| Deionized water | 83.0 g |
| Ink-absorbing layer: | 5 μm |
| Partially saponified polyvinyl alcohol (PVA417 manufactured by Kuraray Co., Ltd.) | 10.0 g |
| Polyoxyethylenesorbitan monopalmitate (Rheodol TW-P120 manufactured by Kao Co., Ltd., HLB: 15.6) | 0.8 g |
| Silicone particles (Tospearl 3120 manufactured by Toshiba Silicone Co., Ltd.) | 0.05 g |
| Polyoxypropylenediethylmethylammonium chloride-modified smectite (prepared according to Example 1 in JP-A-6-287014, and after coating, the average particle diameter was measured under a transmission type electron microscope: about 0.12 μm) | 0.01 g |
| Deionized water | 89.14 g |

TABLE 4

| | Transparency (transmittance) | Printing quality | Ink absorbing power | Adhesion between sheets |
|---|---|---|---|---|
| Example 15 | ◎ (86%) | ○ | ○ | Δ |
| Example 16 | ◎ (83%) | ○ | ○ | Δ |
| Example 17 | ◎ (85%) | ○ | ◎ | Δ |
| Example 18 | ○ (79%) | ○ | ◎ | Δ |
| Example 19 | ◎ (83%) | ○ | ◎ | Δ |
| Example 20 | ◎ (83%) | ○ | ○ | ○ |
| Example 21 | ○ (76%) | ○ | ○ | ◎ |
| Example 22 | ◎ (80%) | ○ | ○ | ○ |
| Example 23 | ◎ (84%) | ○ | ◎ | ○ |
| Example 24 | ◎ (82%) | ○ | ◎ | ○ |
| Example 25 | ○ (78%) | ○ | ◎ | ○ |
| Example 26 | ◎ (82%) | ◎ | ○ | Δ |
| Example 27 | ◎ (83%) | ◎ | ○ | Δ |
| Example 28 | ◎ (82%) | ◎ | ◎ | Δ |
| Example 29 | ◎ (83%) | ◎ | ◎ | Δ |
| Example 30 | ◎ (82%) | ◎ | ○ | ○ |
| Example 31 | ○ (77%) | ◎ | ○ | ○ |
| Example 32 | ○ (76%) | ◎ | ◎ | ○ |
| Example 33 | ○ (78%) | ◎ | ◎ | ◎ |
| Example 34 | ○ (79%) | ◎ | ◎ | ○ |
| Example 35 | ◎ (82%) | ○ | ◎ | ○ |
| Example 36 | ◎ (84%) | ◎ | ◎ | ○ |

Comparative Examples 18 to 21

Coating liquids having the following compositions were applied on one face of a polyethylene terephthalate film (#D535 having a thickness of 100 μm, manufactured by ICI Japan Co., Ltd.) and dried by applying hot air at 120° C. for 5 minutes, whereby coated films having a thickness of 15 μm were formed. The recording characteristics of the recording sheets comprising these components are shown in Table 5.

Comparative Example 18

| | |
|---|---|
| Partially saponified polyvinyl alcohol (PVA417 manufactured by Kuraray Co., Ltd.) | 10.0 g |
| Sorbitan monooleate (Rheodol SP-010 manufactured by Kao Co., Ltd., HLB: 4.3) | 1.0 g |
| Deionized water | 89.0 g |

Comparative Example 19

| | |
|---|---|
| Partially saponified polyvinyl alcohol (PVA217 manufactured by Kuraray Co., Ltd.) | 10.0 g |
| Polyoxyethylenesorbitan monopalmitate (Rheodol TW-P120 manufactured by Kao Co., Ltd., HLB: 15.6) | 0.0005 g |
| Deionized water | 89.9995 g |

Comparative Example 20

| | |
|---|---|
| Partially saponified polyvinyl alcohol (PVA217 manufactured by Kuraray Co., Ltd.) | 10.0 g |
| Polyoxyethylenesorbitan monopalmitate (Rheodol TW-P120 manufactured by Kao Co., Ltd., HLB: 15.6) | 4.0 g |
| Deionized water | 86.0 g |

Comparative Example 21

| | |
|---|---|
| Partially saponified polyvinyl alcohol (PVA217 manufactured by Kuraray Co., Ltd.) | 10.0 g |
| Glycerol (refined glycerol manufactured Kao Co., Ltd.) | 1.0 g |
| Deionized water | 89.0 g |

TABLE 5

| | Transparency (transmittance) | Printing quality | Ink absorbing power | Adhesion between sheets |
|---|---|---|---|---|
| Comparative Example 18 | X (72%) | Δ | Δ | Δ |
| Comparative Example 19 | ⊙ (86%) | X | X | Δ |
| Comparative Example 20 | ⊙ (80%) | X | Δ | X |
| Comparative Example 21 | ⊙ (85%) | X | Δ | Δ |

We claim:

1. A recording sheet comprising a substrate sheet and an ink-absorbing layer provided on at least one surface of the substrate sheet, said ink absorbing layer comprising a water soluble resin or water dispersible resin (A); an ester group-possessing nonionic surfactant (B) having an HLB of 11 or more; and polymethylsilsesquioxane (D) having a particle diameter of 0.5 to 50 microns, wherein the weight ratio of component (A) to component (B) is 100:0.01 to 30, and wherein the weight ratio of component (A) to component (D) is 100:0.01 to 30.

2. A recording sheet comprising a substrate sheet and an ink-absorbing layer provided on at least one surface of the substrate sheet, said ink absorbing layer comprising a water soluble resin or water dispersible resin (A); an ester group-processing nonionic surfactant (B) having an HLB of 11 or more; and a layered silicate (E) modified with an organic treating agent represented by the following Formula (1)

(1)

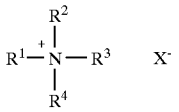

wherein at least one of four substituents $R^1$ to $R^4$ is $(CH_2CH_2O)_nH$ or a

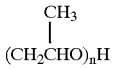

group wherein n is an integer of 1 to 50, and the remaining substituents are linear or branched alkyl group(s) having 1 to 10 carbon atoms or, hydrogen atom(s) and $X^-$ is $Cl^-$, $Br^-$, $NO_3^-$, $OH^-$ or $CH_3COO^-$, wherein the weight ratio of component (A) to component (B) is 100:0.01 to 30, and wherein the weight ratio of component (A) to component (E) is 100:0.01 to 30.

3. The recording sheet as described in claim 2, further comprising an intermediate layer provided between the substrate sheet and the ink-absorbing layer, said intermediate layer comprising the water soluble resin or water dispersible resin (A) and optionally a polyhydric alcohol (C) wherein the weight ratio of component (A) to component (C), (A):(C)=100:0 to 30.

4. The recording sheet as described in claim 2, further comprising a polyhydric alcohol (C) in the ink-absorbing layer such that the weight ratio of component (A) to component (C), (A):(C)=100:0.01 to 30.

5. The recording sheet as described in claim 4, wherein the polyhydric alcohol (C) is at least one selected from the group consisting of glycerol, ethylene glycol, trimethylene glycol, tetramethylene glycol, propylene glycol, diethylene glycol, and polyglycerol having a polymerization degree of 2 or more.

6. The recording sheet as described in claims 2 or 3, further comprising cross-linked silicone particles (D) having particle diameters of 0.5 to 50 $\mu$m in the ink-absorbing layer such that the weight ratio of component (A) to component (D), (A):(D)=100:0.01 to 30.

7. The recording sheet as described in claim 2, wherein the water soluble resin or water dispersible resin (A) is a partially saponified polyvinyl alcohol having a saponification degree of 65 to 90 mole %, or cation-modified polyvinyl alcohol having cationic group-possessing polymerization unit in 0.01 to 25 mole % based on total polymerization units.

8. The recording sheet as described in claim 2, wherein the ester group-possessing nonionic surfactant (B) having an HLB of 11 or more is at least one selected from the group consisting of polyoxyethylenesorbitan monopalmitate, polyoxyethylenesorbitan monostearate, polyoxyethylenesorbitan monolaurate, polyoxyethylenesorbitan monooleate, polyoxyethylenesorbitan trioleate, polyoxyethylenesorbit tetraoleate, polyoxyethylene monopalmitate, polyoxyethylene monostearate, polyoxyethylene monolaurate, polyoxyethylene monooleate, decaglycerol monostearate, hexaglycerol monostearate, decaglycerol monooleate, hexaglycerol monooleate, decaglycerol monolaurate, hexaglycerol monolaurate, decaglycerol monocaprylate, and hexaglycerol monocaprylate.

9. The recording sheet as described in claim 2 wherein the substrate sheet is a polyethylene terephthalate sheet subjected to an anchor coating treatment, corona discharge treatment or blending treatment with a hydrophilic agent.

10. The recording sheet as described in claim 2 wherein the sheet has a transmittance of 75% or more to light having a wavelength of 700 nm.

* * * * *